US009113726B2

(12) United States Patent
Ellis

(10) Patent No.: US 9,113,726 B2
(45) Date of Patent: Aug. 25, 2015

(54) APPARATUS, METHOD AND SYSTEM FOR OPENING A PAPER BAG

(75) Inventor: Kevin J. Ellis, Centerville, UT (US)

(73) Assignee: NCR Corporation, Duluth, GA (US)

( * ) Notice: Subject to any disclaimer, the term of this patent is extended or adjusted under 35 U.S.C. 154(b) by 605 days.

(21) Appl. No.: 12/550,488

(22) Filed: Aug. 31, 2009

(65) Prior Publication Data

US 2011/0048859 A1 Mar. 3, 2011

(51) Int. Cl.
*A63F 9/02* (2006.01)
*A47F 9/04* (2006.01)
*B65B 67/12* (2006.01)

(52) U.S. Cl.
CPC ..... *A47F 9/042* (2013.01); *B65B 67/1266* (2013.01)

(58) Field of Classification Search
CPC ..... A47F 13/085; A47F 5/0884; A47F 5/04; A47F 5/0006; A47F 5/0892; A47L 19/04; A47G 29/00; A47G 23/0208; A47B 81/04; A47J 47/16; A01K 97/06; A45F 9/04; A45F 9/042; A45F 9/043; B07C 7/02; B60R 7/02; B60R 7/08; B65B 67/1244; B65B 43/123; B65B 67/04; B65B 67/1227; B65B 67/1205; B65B 67/12; B65B 67/1238; B65B 67/1255; B65B 39/06; B65B 39/08; B65B 67/1233; B65B 69/0008; B65F 1/1415; B65F 1/1468; B65F 1/06; B65F 1/141; B65F 1/1421; B65F 1/0006; A61J 1/10; A47K 3/281; B62B 2202/404; B62B 1/06; B62B 2202/22; B62B 3/106; B62B 1/264; B62B 2202/20; A63B 55/04; A63B 55/045; A63B 55/08; A47C 3/04; A47C 3/00; A47C 7/0077; A47C 3/045; A47C 13/06; A47C 3/06; A47C 11/20; A47C 13/04; D06F 53/005; D06F 95/004; B65D 88/1618; B65D 33/10; B65D 33/105; B65D 33/12; B65D 33/16; B65D 33/14; B65D 88/1668; B65D 88/1681; B65D 88/1612; B65D 88/1687; B65D 33/06; B65D 33/243; B65D 33/246; B65D 29/00; B65D 33/007; B65D 33/02; B65D 33/30; B65D 75/5866; B65D 75/008; B65D 75/5822; B65D 75/5883

USPC ..... 383/6, 12, 22–25, 33, 34, 906; 211/12, 211/85.15, 85.19, 85.29, 85.106, 106, 119, 211/175; 248/95–101; 186/66

See application file for complete search history.

(56) References Cited

U.S. PATENT DOCUMENTS

| | | | | | |
|---|---|---|---|---|---|
| 3,313,504 | A * | 4/1967 | Stoltze | 248/99 |
| 3,514,015 | A * | 5/1970 | Hein | 221/47 |
| 3,679,096 | A * | 7/1972 | Musser | 221/56 |
| 4,005,801 | A * | 2/1977 | Musser | 221/56 |
| 4,723,743 | A * | 2/1988 | Jenkins | 248/97 |
| 4,750,695 | A * | 6/1988 | Greenhouse | 248/99 |
| 4,762,297 | A * | 8/1988 | Milligan | 248/99 |
| 5,300,736 | A * | 4/1994 | Ehrhardt | 177/145 |
| 5,513,823 | A * | 5/1996 | Bresnahan | 248/99 |
| 6,145,629 | A * | 11/2000 | Addy | 186/61 |
| 2007/0144989 | A1* | 6/2007 | Alvarado | 211/85.15 |
| 2007/0176058 | A1* | 8/2007 | Kohn et al. | 248/100 |
| 2008/0053929 | A1* | 3/2008 | Nguyen et al. | 211/50 |
| 2009/0289019 | A1* | 11/2009 | Alvarado et al. | 211/85.15 |
| 2010/0314507 | A1* | 12/2010 | Laitila et al. | 248/97 |

* cited by examiner

*Primary Examiner* — Jeffrey Shapiro
(74) *Attorney, Agent, or Firm* — Harden E. Stevens, III; Joseph P. Mehrle

(57) ABSTRACT

A bag rack, method and system for reducing the time needed to open a bag and have it ready for use at a checkout terminal or other station where the time required to opening a bag is critical. The rack allows a bag to be opened with one hand using a single upward and forward motion.

19 Claims, 6 Drawing Sheets

APPARATUS, METHOD AND SYSTEM FOR OPENING A PAPER BAG

TECHNICAL FIELD

The invention described herein relates generally to improvements to a checkout terminal. More particularly, the invention relates to improving the deployment of a paper bag at a checkout terminal.

BACKGROUND

Items that are purchased at a checkout terminal are typically placed in some type of bag to allow the purchaser to easily transport the items. Deployment of a bag can be problematic and cause a delay in the process of purchasing items. This delay increases the time needed to process a transaction. Delays in deploying bags also cause security features of the checkout terminal to misidentify the action of deploying a bag as an attempt to perform an illegal act. The misidentification causes additional delays as store personnel must be summoned to determine what happen and then return the checkout terminal to normal operation. Deployment of a bag made of paper is known to be problematic.

Therefore, it would be desirable to provide a bag deployment device that over comes these and other problems.

BRIEF DESCRIPTION OF THE DRAWINGS

The invention, in accordance with preferred and exemplary embodiments, together with further objects and advantages thereof, is more particularly described in the following description taken in conjunction with the accompanying drawings in which like reference characters designate the same or similar parts throughout the several views and wherein.

DETAILED DESCRIPTION

In the following description, numerous details are set forth to provide an understanding of the claimed invention. However, it will be understood by those skilled in the art that the claimed invention may be practiced without these details and that numerous variations or modifications from the described embodiments are possible.

Figure 1:
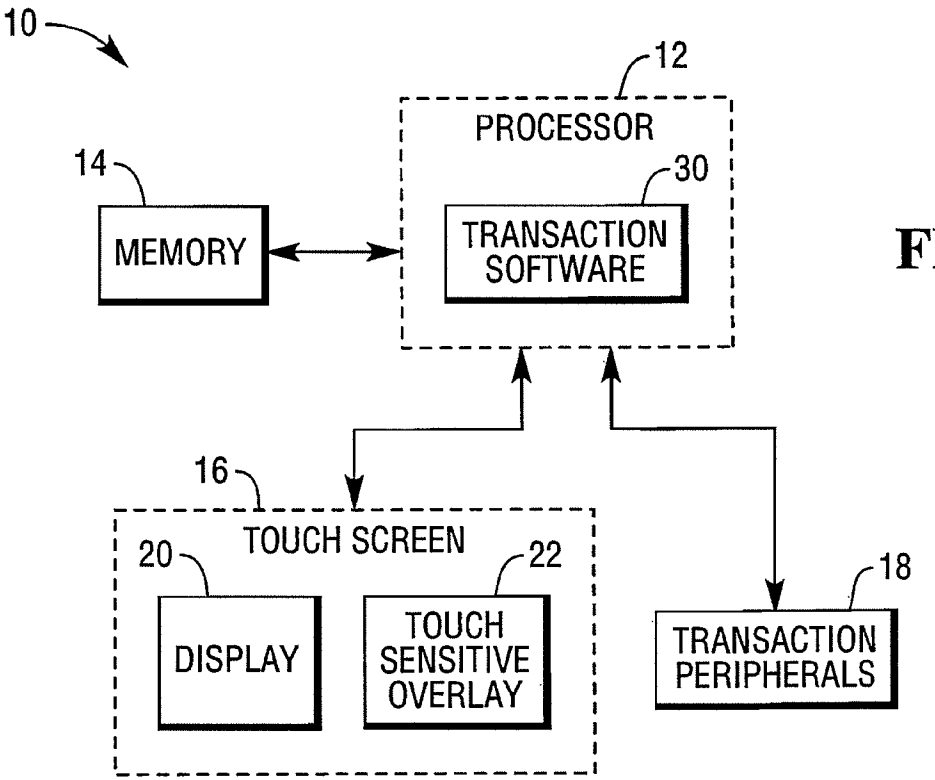
FIG. 1 is a block diagram of an example embodiment of a self-service checkout station.

Referring now to FIG. 1, a self-service checkout station 10 includes a processor 12, a memory 14, a touch screen 16, and a number of transaction peripherals 18 arranged in one or more cabinets or housings.

The processor 12 executes transaction software 30. The transaction software 30 displays transaction options and instructions, records operator inputs, and controls operation of transaction peripherals 18. The transaction software 30 includes security software that monitors operator actions to detect improper actions. The memory 14 stores the transaction software 30 and the data used by transaction software 30.

Touch screen 16 includes a display 20 and a touch sensitive overlay 22. Display 20 may include a bi-stable display, cholesteric display, liquid crystal display, organic LED (OLED) display, or any other type of display capable of use with touch overlay 22.

Displayed information may include text, graphics, or a combination thereof. For example, the information may include arrows or other graphic symbols for directing operators to use peripherals.

Touch screen 16 may display many different types of information. For example, touch screen 16 may display active transaction instructions and options, information and instructions related to the transaction such as running balance, coupon and loyalty information (reminder to scan loyalty card), and completely unrelated information such as ads for other products and services, including products and services in the same store (e.g., pharmacy, photo lab, and deli).

In some embodiments, display 20 may display messages in a plurality of colors.

Figure 2:
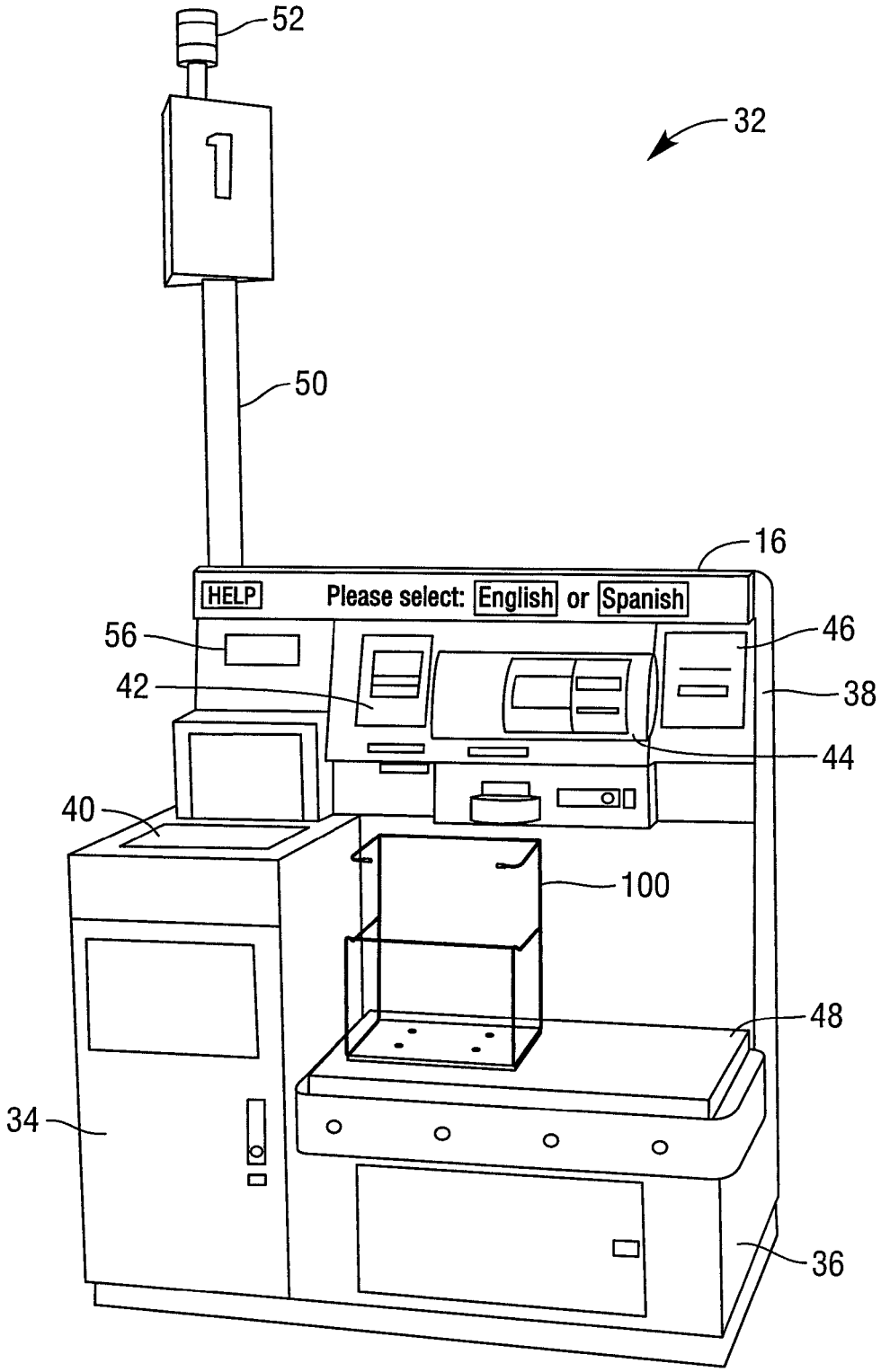
FIG. 2 is an example embodiment of a self-service checkout station.

With reference to FIG. 2, there is provided an example embodiment of a self-service checkout station 32. The self-service checkout station 32 may be one of a group of self-service stations and may have an attendant station that monitors the group of self-service stations.

The self-service checkout station 32 includes housing sections 34, 36, 38, which support a touch screen 16 and peripherals 18. The self-service checkout station 32 includes a dual-aperture barcode scanner with item scale 40, a card reader 42, a cash (currency and/or coin) dispenser and/or acceptor 44, a receipt printer 46, one or more security scales 48, a bag rack 100 and a light post 50 with a signaling light 52.

The self-service checkout station 32 may be configured with more or fewer peripherals 18. For example, the self-service checkout station 32 may include a radio frequency identification tag reader, a signature capture pad, check reader, or other peripheral as dictated by the retailer where the self-service checkout station 32 is located.

The touch screen 16 is mounted to the housing section 38, in a position above the scanner 40, card reader 42, cash dispenser/acceptor 44, and receipt printer 46. Touch screen 16 spans substantially the entire width of the housing section 38.

The touch screen 16 displays instructions and prompts in an active portion. The active portion includes information involved in completing a transaction. The active portion 24 may vary in size and gradually shift horizontally as the transaction progresses, so that the displayed information is positioned roughly adjacent to and above the related peripherals 18.

In a remaining passive portion, the touch screen 16 displays advertisements, information about products, promotions, eye-catching graphics inviting shoppers to use the system (commonly called "attract screens)," or possibly nothing. The passive portion includes information that is not necessarily involved in completing a transaction. However, the passive portion may display information related to products involved in a transaction. The passive portion may include touch sensitive areas that a customer may select if the customer wishes further information.

Card reader 42, cash dispenser/acceptor 44, and receipt printer 46 are also located within the housing section 38. The barcode scanner 40 is mounted within another housing section 34. The security scale 48 is mounted within yet another housing section 36. A computer, comprising the processor 12, memory 14 or other components, is housed inside the housing section 36.

When a customer approaches the self-service checkout station 32, the touch screen 16 may display an initial message, such as "Checkout faster here", alternating with "Touch screen to begin" or "Please select English or Spanish." The active portion may be centered. One or more passive portions may occupy the rest of touch screen 16.

As a customer proceeds through a transaction, the transaction software 30 executed by the processor 12, causes the touch screen 16 to display transaction related information and prompts, and records selections necessary to complete the transaction.

For example, following each step in a transaction requiring a customer to act, the transaction software 30 may cause touch screen 16 to display a message, graphic, or other prompt requesting a selection from the customer or directing the customer to an appropriate peripheral 18.

The transaction software 30 may also generate voice messages supporting or echoing messages or prompts displayed by touch screen 16 through one or more speakers 56.

As a customer proceeds through a transaction, the transaction software 30 causes touch screen 16 to display transaction related information and prompts, and records selections necessary to complete the transaction. The transaction software 30 includes security software that monitors a customer's actions to determine if any action is improper.

Figure 3:
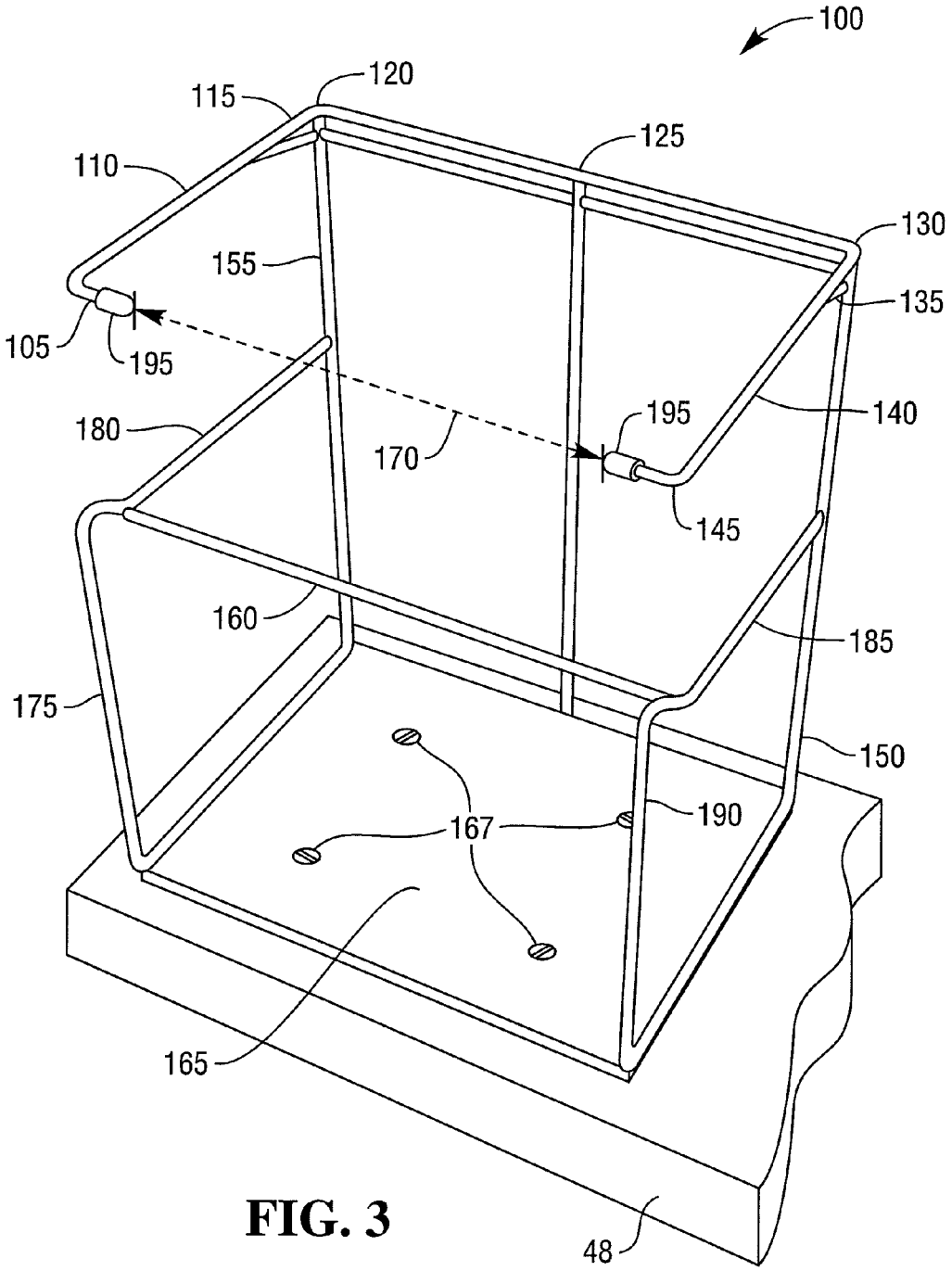
FIG. 3 is a high level diagram illustrative of an embodiment of an open assist bag rack.

With reference to FIG. 3, there is provided a high level illustration of an embodiment of an open-assist bag rack 100. The rack 100 can be free standing or attached to the self-service checkout station 32 or to assisted service checkout station. (Note: in this application the term checkout station is equivalent to a point-of-sale terminal.) The rack 100 has a pair of upper side support arms 110,140. The left upper side support arm 110 has a rear portion 115 that is connected to an upper transverse member 125, located at the rear of the rack 100, at attach point 120. The left upper side support arm 110 has a front portion 105 that extends perpendicular to the arm 110 toward the center of the rack 100. The right upper side support arm 140 has a rear portion 135 that is connected to the upper transverse member 125 at attach point 130. The right upper side support arm 140 has a front portion 145 that extends perpendicular to the arm 140 toward the center of the rack 100. The front portion 105 of the left upper side support arm 110 and the front portion 145 of the right upper side support arm 140 extend toward each other but do not meet and thus form a gap 170 between the end of the two portions 105,145. The rack 100 has a bottom member 165 that supports unopened bags and an open bag. A left rear vertical member 155 and a right rear vertical member 150 connect the bottom member 165 to the upper transverse member 125. A front transverse catch bar 160 is connected to the bottom member 165 by two members 175, 190 and to the left rear vertical member 155 by member 180 and to the right rear vertical member 150 by member 185. The rack 100 can have other structural members that provide support and rigidity. In some embodiments, the rack 100 is attached to the security scale 48 of a self-service checkout station 32. In some embodiments, the attachment is made by placing four screws 167 from the bottom member 165 into the top plate of the security scale 48. In other embodiments, the rack 100 has additional structural members that provide support or attachment points for the rack 100 to attach to other types of terminals or stations.

A cap 195 is placed on each end of each front portion 105, 145 of the upper side support arms 110, 140. The caps 195 protect the bag from being damaged by any irregularities in the ends as parts of the bag 300 (FIG. 5) move past the ends. The caps 195 cover any defect in workmanship or the material that may comprise the end of each front portion 105, 145. The caps 195 are designed to have a coefficient of friction that creates a small drag force between each cap 195 and the portion of the bag 300 that the cap 195 contacts. This drag force retards the moment of the rear vertical flap 310 of the bag 300 while allowing the front 305 of the bag 300 to continue its moment unretarded. This action causes the upper portion of the bag 300 (i.e., the front vertical fold 325 and rear vertical fold 305) to unfold and the mouth and upper portion of the bag 300 to move from a closed configuration to an open configuration. In addition to creating drag, the coefficient of friction for the cap must also allow the bag 300 to properly slip past the caps without causing any damage to bag 300 due to friction between the caps 195 and bag 300 (i.e., the caps 195 should not tear or abrade the bag 300). The coefficient of friction can be changed, for example by changing the surface finish of the caps 195 or the material used to make the caps 195 or a combination thereof. The caps 195 are replaceable should they ware out. If the surface finish or material used to make the bag 300 changes resulting in different surface properties, the caps 195 can be replaced with caps designed to work with the new bag 300 finish or material or both. In some embodiments, caps 195 are not used and steps are taken to give the ends of each front portion 105, 145 the proper finish so they perform the same function as the caps 195. This may or not involve additional processing of the ends.

In some embodiments, the rack 100 is attached to the security scale 48 and the operation of the rack 100 is integrated into the security software that is executed by the processor 12. The security scale 48 determines the weight of the rack 100 and any bags or items that are in the rack 100. Changes in the weight are reported to the security software to determine if any improper actions have occurred. An improper action would be any action that would result in an item not being properly identified or valued. If an improper action is detected, the security software will take actions to stop the improper action such as notifying a supervisor and displaying messages to the operator.

Figure 4:
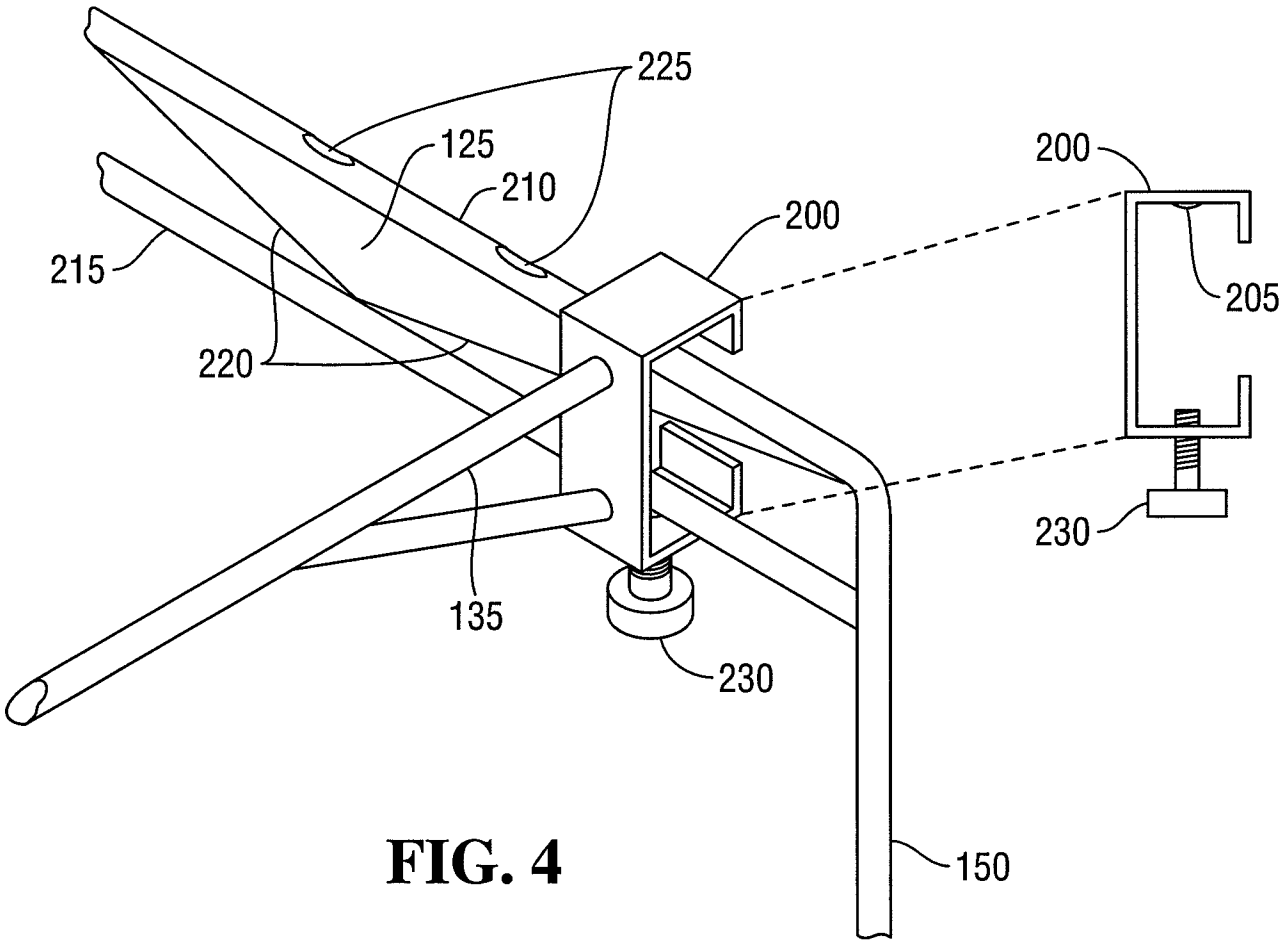
FIG. 4 is a high level diagram illustrating an embodiment depicting an expanded view of the upper right rear corner of the rack 100, from FIG. 3.

Turning to FIG. 4, there is presented an embodiment depicting an expanded view of the upper right rear corner of the rack 100, from FIG. 3. In FIG. 3, the rear sections 115, 135 of the upper side support arms 110, 140 are rigidly attached to the upper transverse member 125. However, this embodiment depicts the rear sections 115, 135 of the upper side support arms 110, 140 attached to the upper transverse member 125 but able to slide across the upper transverse member 125. The rear section 135 of the right upper side support arm 140 is rigidly connected to a slidable device 200. The device 200 is attached to the upper transverse member 125 so that the device 200 is movable across the upper transverse member 125. The upper transverse member 125 is comprised of an upper horizontal member 210 and parallel lower horizontal member 215 with diagonal members 220 connecting the two members 210, 215. In other embodiments, the upper transverse member 125 is comprised of a single member or other structural member that provides the same features.

In some embodiments, the upper horizontal member 210 has a plurality of notches 225 or detents at predetermined locations and the device 200 has a protruding catch 205 aligned to drop into the notches 225 as the device 200 slides across the upper transverse member 125. When the catch 205 drops into one of the notches 225, the movement of the device 200 across the upper transverse member 125 stalls until additional force is applied to move the catch 205 out of the notch 225. The notches 225 on the upper transverse member 125 are placed at locations that correspond to different sized bags that can be used in the rack 100. By moving the left and right upper side support arms 110, 140 to rest in the proper notches 225, the front portions 105, 145 of each upper side support arm will be the proper distance apart for the size bag that corresponds to the notches 225 being used. Thus, by moving the upper side support arms 110, 140 to different notches 225 on the upper transverse member 125, different sized bags can be used in the rack 100.

In some embodiments, a locking device 230 is added to the device 200 to hold or lock the device 200 in any position along the upper transverse member 125 whether or not there is a notch at the desired position. This allows for the use of non-standard bag sizes by allowing the upper side support arms 110, 140 to be moved and locked to any position on the upper transverse member 125. The locking device 230 comprises a thumbscrew that is adjusted by hand and when engaged, applies pressure to the upper transverse member 125 causing the device 200 to lock in place. In other embodiments, the locking device 230 comprises different components and uses different methods to lock the device 200 at a position on the upper transverse member 125 (e.g., a spring loaded latch).

FIG. 4 illustrates the device 200 for the right upper side support arm 140. A device similar to device 200 is used to perform the same functions for the left upper side support arm 110.

In embodiments where each of the upper side support arms 110, 140 are rigidly attached to the upper transverse member 125 and are not moveable, the upper side support arms 110, 140 are fixed in a position corresponding to a certain size bag. Different sized bags require different bag racks 100. Some checkout terminals have multiple racks 100 to be able to use multiple bag sizes.

Figure 5:
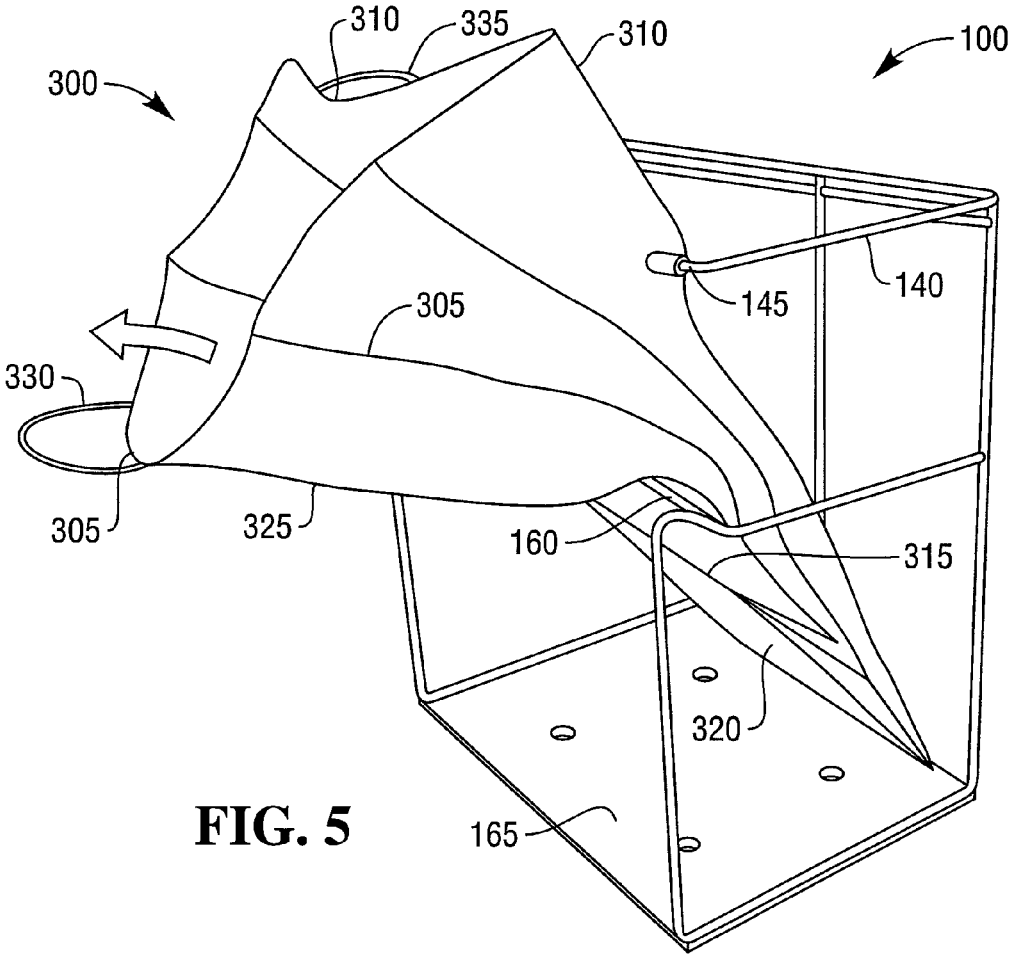
FIG. 5 a high level illustration of a bag 300 being opened in the bag rack 100.

FIG. 5 is a high level illustration of a bag 300 being opened in the rack 100. The bag 300 is initially in a closed configuration and resting vertically on the bottom member 165 of the rack 100. As the bag 300 is pulled forward and upward, the upper portion of front vertical fold 305 of the bag 300 slips past the front portions 105, 145 of each of the upper side support arms 110,140 (left upper support arm 110 not shown). As the bag 300 continues to move forward, the end of the front portion 105, 145 of each of the upper side support arms 110, 140 retards the forward movement of the rear vertical fold 310 of the bag 300, which causes the mouth and upper section of the bag 300 to move to an open configuration. As the bag 300 also moves upward, the leading edge 315 of the floor flap 320 of the bag 300 catches and goes under the front transverse catch bar 160 while the remainder of the bag 300 move over the top of the catch bar 160. This action causes the floor flap 320 to unfold; moving the lower portion of the bag 300 to an open configuration. Once in the open configuration, the bag 300 is lowered back to rest on the bottom member 165 of the rack 100. This process allows the bag 300 to be opened using only one hand to grasp a closed bag 300 and move it forward and upward causing the bag 300 to open. The bag 300 has two handles 330, 335. The handle 330 closest to the front of the rack 100 is used to pull the bag 300 forward and upward. In other embodiments, a notch is cut the out of the rear top center 310 of the bag 300 (the location of the notch area 310 is labeled but the cut out for the notch is not shown). This allows only the front side 305 of the bag 300 to be grasped and used to pull the bag 300 forward and upward to open it.

The catch bar 160 is located above the bottom member 165 and below the upper side support arms 110, 140. As the upper portions of the bag 300 move by the ends of the upper side support arms 110, 140, the upper portion of the bag 300 begins to open. This causes the lower portion of the bag 300 (comprising the floor flap 320) to flex which causes the leading edge 315 of the floor flap 320 to separate from its closed position resting against the side of the bag 300. The catch bar 160 is positioned to allow the leading edge 315 of the floor flap 320 to separate from the bag 300 prior to the leading edge 315 reaching the catch bar 160 as the bag 300 is pulled upward and forward. The separated leading edge 315 then moves under the catch bar 160 while the main portion of the bag 300 continues to move over the top of the catch bar 160. As the bag 300 continues to move, the catch bar 160 causes the floor flap 320 to move to the open configuration. The catch bar 160 is recessed rearward from the front of the rack 100. However, in some embodiments, the catch bar 160 is even with the front of the rack 100. In still other embodiments, the catch bar 160 is movably fixed to the rack 100 so that it can be adjusted to a position appropriate for the bag 300 being used in the rack 100.

Figure 6:
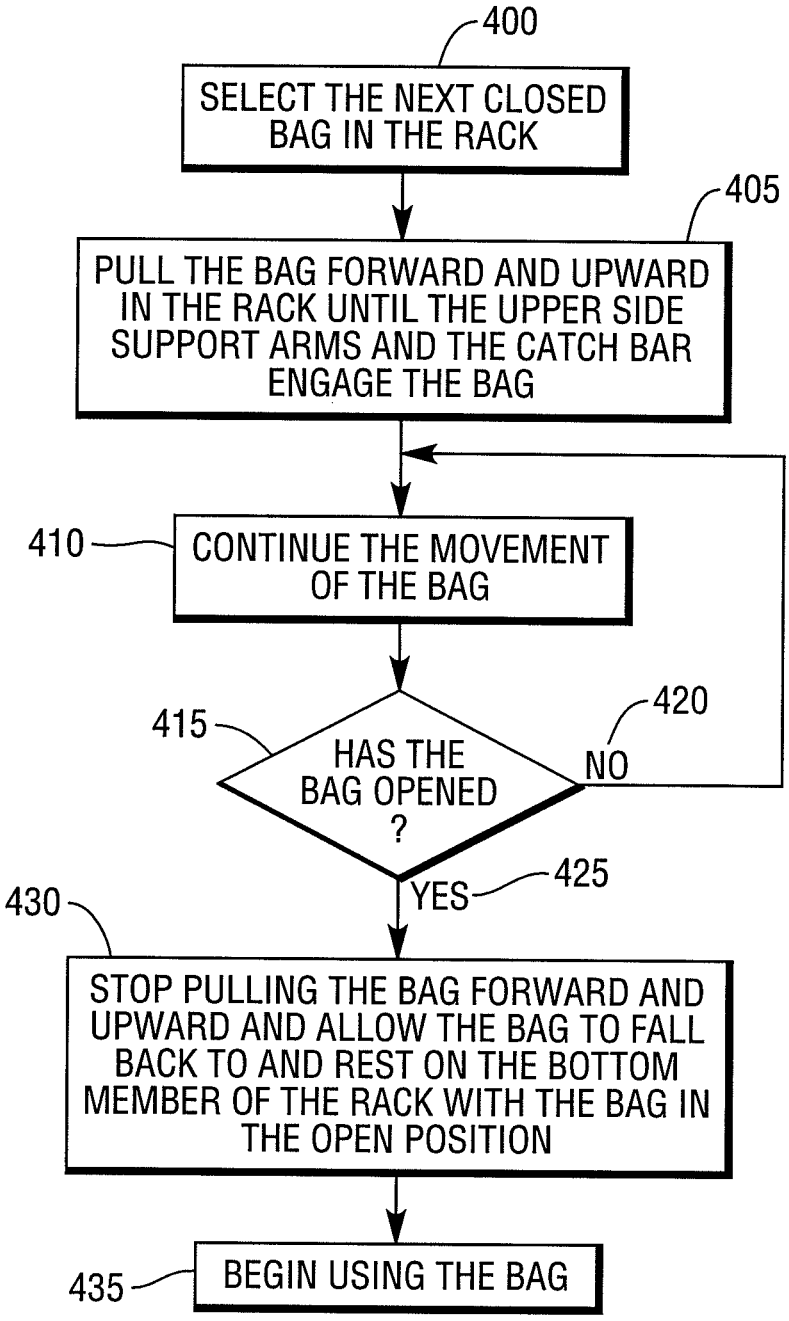
FIG. 6 is a flow diagram of a process used to open a bag 300 in the bag rack 100.

FIG. 6 is a flow diagram of a process used to open a bag 300 in the bag rack 100. In step 400, the next closed bag 300 is selected. The rack 100 has an area at the rear where one or more vertically standing closed bags are stored. These bags are in a closed configuration. The bags rest on the bottom member 165. In step 405, the selected bag 300 is pulled forward and upward from its resting place in the back of the rack 100 until the end of each front portion 105, 145 of the upper side support arms 110, 140 and the catch bar 160 engage the bag 300. The bag 300 is moved forward until the front vertical fold 305 contacts the ends of the front portions 105, 145 of the upper side support arms 110, 140. The bag 300 is moved upward until the leading edge 315 of the floor flap 320 catches on and goes under the front transverse catch bar 160. In step 410, the bag 300 continues to move forward and upward as the ends of the front portions 105, 145 and the catch bar 160 causes the bag 300 to open. Step 415 determines if the bag 300 is open. If the bag 300 is not open 420, the process returns to step 410. If the bag 300 is open 425, the process moves to step 430. In step 430, the forward and upward movement of the bag 300 is stopped and the now open bag 300 is lowered down to rest on the bottom member 165. The open bag 300 is in an open configuration. In step 435, the process of using the bag 300 begins. The process of selecting a closed bag 300 and then pulling the bag 300 forward and upward can be accomplished using only one hand of the operator or user. This frees the other hand to perform other functions such as holding or picking up the item, which speeds up the checkout or bagging process.

In embodiments where the rack 100 is attached to the security scale 48, security software, executed by the processor 12, monitors the action of opening a bag 300. During the time when a bag 300 is being opened, the weight readings from the security scale 48 will vary making if difficult or impossible for the security software to determine if an improper action is taking place or just the opening of a bag 300. The longer it takes to open a bag 300, the longer the time period during which security software cannot determine if an improper action is taking place. The security software has a maximum time period for opening a bag 300 and once this maximum is reaches, any unaccountable variation in weight from the security scale 48 will be deemed an improper action. By reducing the time required to open a bag 300, the security software's maximum time period for opening a bag can be reduced. This is desirable because it reduces the time during which improper actions can occur but not be detected.

In the above embodiment, the bag is made of paper. In other embodiments, the bag is made from other materials or combinations of materials but the bag still has the characteristics (i.e., a floor flap and two vertical flaps) of the paper bag that allow it to work with the above described bag rack so the bag rack will operate to open the bag.

While the invention is disclosed in the context of a bag rack used at checkout terminal, it will be recognized that a wide variety of implementations may be employed by a person of ordinary skill in the art consistent with the above discussion and the claims, which follow below. In addition, the bag rack can be used in implementations not associated with a checkout terminal such as in a production line where items must be placed in a bag after the bag is opened.

What is claimed is:

1. A bag rack for opening and supporting a bag, the rack comprising:

an upper transverse member substantially located at the top and rear of the rack;

a pair of upper side support arms disposed opposite each other, each support arm including a front and a rear portion where the front portion of each support arm is angled toward the opposite support arm and where each front portion is disposed to contact a side of the bag and where each rear portion is attached to the upper transverse member;

a front transverse catch bar disposed below the upper side support arms and forward of the front portion of each upper support arm and disposed across the front of the rack and disposed above the bottom of the rack at a distance greater than the distance between the leading and trailing edge of a floor flap of the bag and configured to catch the leading edge of the floor flap of the bag as the bag moves upward;

a bottom floor member disposed below the catch bar and extending across the rack and configured to support the bag when the bag is closed and open, wherein the bottom floor member is adapted to receive screws to affix the bag rack to a top plate of a security scale; and wherein the bag rack is configured such that when the bag, in a closed configuration and in contact with the bottom floor member, the bag is moved forward and upward the front portion of each support arm is adapted to retard the movement of the rear vertical flap of the bag whereby opening the upper portion of the bag, and the catch bar is adapted to catch and unfold the floor flap of the bag opening the bottom portion of the bag such that the support arms and the catch bar are adapted to cooperate to transform the bag to an open configuration and wherein the bottom floor member is adapted to support the bag when the bag is in the open configuration.

2. The bag rack of claim 1, further comprising a cap attached to the end of the front portion of each support arm.

3. The cap of claim 2, where the cap is comprised of a material with a coefficient of friction such that the cap impedes the movement of the rear vertical flap of the bag past the cap but also protects the bag from damage as it moves past the cap on each support arm.

4. The bag rack of claim 1, where the support arms, the upper transverse member and bottom member are disposed to support one or more bags in the closed position.

5. The bag rack of claim 1, where each attachment between the upper side support arms and the upper transverse member is a slidable attachment and where the upper side support arms are disposed to slide in or out across the upper transverse member to adjust for different size bags.

6. The bag rack of claim 5, where the upper transverse member includes one or more detents that communicate when each of the upper side support arms are properly aligned for a bag size.

7. The bag rack of claim 5, where each attachment between the upper side support arms and the upper transverse member includes a locking device where the locking device when engaged prevents the upper side support arm from sliding across the upper transverse member.

8. The bag rack of claim 1, where the bag is comprised of paper.

9. A checkout terminal system comprising:

a checkout terminal where the terminal processes one or more items for sale; and a bag rack for opening and supporting a bag, the rack comprising:

an upper transverse member substantially located at the top and rear of the rack;

a pair of upper side support arms disposed opposite each other, each support arm including a front and a rear portion where the front portion of each support arm is angled toward the opposite support arm and where each front portion is disposed to contact a side of the bag and where each rear portion is attached to the upper transverse member;

a front transverse catch bar disposed below the upper side support arms and forward of the front portion of each upper support arms and disposed across the front of the rack and disposed above a bottom of the rack at a distance greater than the distance between the leading and trailing edge of a floor flap of the bag and configured to catch the leading edge of the floor flap of the bag as the bag moves upward;

a bottom floor member disposed below the catch bar and extending across the rack and configured to support the bag when the bag is closed and open; and wherein the bag rack is configured such that when the bag, in a closed configuration and in contact with the bottom floor member, the bag is moved forward and upward the front portion of each support arm retards the movement of the rear vertical flap of the bag whereby opening the upper portion of the bag, and the catch bar catches and unfolds the floor flap of the bag opening the bottom portion of the bag such that the support arms and the catch bar cooperate to transform the bag to an open configuration and wherein the bottom floor member supports the bag when the bag is in the open configuration, and wherein the bottom floor member is adapted to receive screws to affix the bag rack to a top plate of a security scale.

10. The bag rack of claim 9, further comprising a cap attached to the end of the front portion of each support arm.

11. The cap of claim 10, where the cap is comprised of a material with a coefficient of friction such that the cap impedes the movement of the rear vertical flap of the bag past the cap while at the same time not causing damage to the bag.

12. The bag rack of claim 9, where the support arms, the upper transverse member and bottom member are disposed to support one or more bags in the closed position.

13. The bag rack of claim 9, where the attachment between the upper side support arms and the upper transverse member is a slidable attachment and where the upper side support arms are disposed to slide in or out to adjust for different size bags.

14. The bag rack of claim 13, where the upper transverse member includes one or more detents that communicate when each of the upper side support arms are properly aligned for a bag size.

15. The bag rack of claim 9, where each attachment between the upper side support arms and the upper transverse member includes a locking device where the locking device when engaged prevents the upper side support arm from sliding across the upper transverse member.

16. The bag rack of claim 9, where the bag is comprised of paper.

17. The checkout terminal system of claim 9, where the checkout terminal further comprises a weigh scale where the weigh scale determines the weight of the bag rack and its contents.

18. The checkout terminal system of claim 17, further comprising security software that uses the weight of the bag rack and its contents to determine if an improper action has occurred.

19. The checkout terminal system of claim 18, where the security software uses a reduced maximum time to open a bag to determine if an improper action has occurred.

* * * * *